US005853253A

United States Patent [19]

No

[11] Patent Number: 5,853,253

[45] Date of Patent: Dec. 29, 1998

[54] PRINTER AND METHOD ADAPTED TO PRECISELY POSITION A DYE RECEIVER PORTION

[75] Inventor: Young No, Pittsford, N.Y.

[73] Assignee: Eastman Kodak Company, Rochester, N.Y.

[21] Appl. No.: 950,646

[22] Filed: Oct. 15, 1997

[51] Int. Cl.[6] ..... B41J 2/325; B65H 23/185

[52] U.S. Cl. ..... 400/120.02; 400/611; 242/563.2; 242/420.5

[58] Field of Search ..... 400/120.02, 611; 101/484; 242/420.5, 563, 563.2

[56] References Cited

U.S. PATENT DOCUMENTS

| | | | |
|---|---|---|---|
| 4,738,553 | 4/1988 | Uemura et al. | 400/120 |
| 4,892,426 | 1/1990 | Steele | 400/708 |
| 4,925,121 | 5/1990 | Tapscott et al. | 101/484 |
| 5,280,274 | 1/1994 | Uemura et al. | 226/11 |
| 5,405,069 | 4/1995 | Duncan et al. | 226/25 |
| 5,501,412 | 3/1996 | McAleavey | 242/417.1 |
| 5,549,400 | 8/1996 | Tang et al. | 400/236 |
| 5,556,492 | 9/1996 | Vonderhorst et al. | 242/334.2 |
| 5,725,321 | 3/1998 | Brannan et al. | 400/708 |

*Primary Examiner*—Edgar Burr
*Assistant Examiner*—Daniel J. Colilla
*Attorney, Agent, or Firm*—Walter S. Stevens

[57] ABSTRACT

A printer and method adapted to precisely position a dye receiver portion. The printer and method properly positions the dye receiver portion for printing successive images onto the dye receiver portion with precise color registration and constant length, as the dye receiver portion unwinds from a roll of dye receiver. The printer comprises a print head for successively printing the images on the dye receiver and includes a rotator engaging the dye receiver roll for rotating the dye receiver roll by a plurality of incremental steps, so that the dye receiver is unwound from the dye receiver roll. The printer also includes a computer connected to the dye receiver roll for computing the incremental steps by which to rotate the dye receiver roll. The computer computes the incremental steps as a function of change of diameter of the dye receiver roll as each image of constant predetermined length is successively printed.

8 Claims, 2 Drawing Sheets

PRINTER AND METHOD ADAPTED TO PRECISELY POSITION A DYE RECEIVER PORTION

FIELD OF THE INVENTION

The present invention generally relates to printer apparatus and methods and more particularly relates to a printer and method adapted to precisely position a dye receiver portion for printing successive images onto the dye receiver portion with precise color registration and constant length, as the dye receiver portion unwinds from a roll of dye receiver.

BACKGROUND OF THE INVENTION

In a typical thermal resistive printer, a dye donor ribbon containing a repeating series of frames of different color heat transferable dyes (e.g., yellow, cyan and magenta colors) is spooled on a dye donor supply spool. The dye donor ribbon, which is typically formed from a thin and flexible dye carrying substrate, is fed from the supply spool and simultaneously rewound onto a take-up spool. The donor ribbon moves through a nip defined between a thermal resistive print head and a dye-absorbing dye receiver. The dye receiver is in turn supported by a platen disposed adjacent the print head.

That is, at the beginning of the printing cycle, the print head is lifted away from the platen roller to allow the dye receiver to be transported to and placed upon the platen. In this regard, the dye receiver transport system may be a set of capstan rollers. The print head engages the dye ribbon and presses the dye ribbon against the dye receiver to form a dye ribbon/dye receiver media sandwich. In this regard, the receiver may be cut sheets of coated paper or transparency and the print head may be formed of, for example, a plurality of thermal resistive heating elements. When predetermined ones of the heating elements are energized, the heating elements are heated. In the presence of such heat and pressure, dye from the dye ribbon transfers to the dye receiver. Density of the dye printed on the receiver is a function of the heat energy delivered from the heating elements to the dye ribbon. Such printers offer the advantage of "continuous tone" dye density transfer by varying the heat energy applied to the heating elements, thereby yielding a plurality of variable dye density image pixels onto the receiver.

More specifically, to begin printing, a first dye frame (e.g., a yellow color dye frame) is advanced to a position under the print head. The raised print head is then lowered to apply pressure on the dye ribbon/dye receiver media sandwich. This media sandwich slides under the print head and the heating elements are selectively energized to form a row (i.e., "print line") of yellow image pixels under the print head. The platen is then rotated to allow printing of successive lines of the yellow portion of the final image. When the yellow portion of the image has been deposited, the print head is again raised to reposition the dye ribbon for the next color frame. The dye receiver transport system then brings back the receiver and places the beginning of the yellow image print under the print head. The dye ribbon is controlled during this repositioning, so that the next color dye frame (e.g., magenta) is positioned under the print head. The print head is then lowered to reestablish contact with the media sandwich and this next color dye frame is deposited onto the receiver. This process of raising the print head, repositioning the receiver, lowering the print head and energizing the thermal resistive elements is repeated for printing the next color dye frame (e.g., cyan). The three dyes (e.g., yellow, magenta and cyan colors) are thus blended during the printing process for obtaining a full-color image. The printing process is complete when the three colors are deposited onto the receiver. The process of repositioning the dye receiver to the platen for each color frame is preferably accomplished in a manner allowing each color frame's print lines to be precisely and repeatedly positioned atop each other without misregistration.

Many thermal resistive printers use a stepper motor to transport the cut sheets of receiver. The linear distance the receiver travels per stepper motor step does not change because a fixed stepper step rate is used to control the receiver transport system. Placement of the cut sheet of receiver for each color frame is achieved by counting the number of steps required to print a color frame and then stepping the stepper motor backward by the same number of steps to reposition the receiver for printing the next color frame.

However, in some thermal resistive printers, a roll of receiver is used to supply the dye receiver rather than use of precut sheets of dye receiver. This is done to reduce receiver manufacturing costs. In these printers, the image is printed on the dye receiver while the dye receiver is still attached to the supply roll of receiver. The portion of the receiver containing the image is later cut from the supply roll of receiver after the image is printed. Such a receiver roll can have any number of printable units of receiver; but, a typical receiver roll contains about 25 to 50 printable units.

Moreover, in printers using receiver rolls, the receiver roll drive system is used as the primary receiver transport system. However, in printers that use the receiver roll drive system to transport and position the receiver, the method of using the previously mentioned fixed stepper step rate to transport the receiver and simply counting the steps of the stepper motor and then using the counts to reposition the receiver cannot be used because the diameter of the receiver roll changes as the printed receiver is cut from the receiver roll. For example, if the diameter of the receiver roll is one inch and the receiver roll holds 25 print units, the final diameter of the receiver roll will be 1.64 inches, with a receiver eight mils thick. Thus, it will require 1.64 times more stepper motor steps to advance the receiver the same distance at the end of the receiver roll than at the beginning of the receiver roll. Therefore, in printers using receiver rolls, the first print will be 1.64 times smaller in length than the last print when a fixed step rate is used for the entire roll during transport of the receiver. It is therefore desirable to provide a thermal resistive printing device which precisely repositions the dye receiver in a manner that takes into account the changing diameter of the receiver roll.

Thermal printer positioning devices are known. An apparatus and method for positioning a dye donor web relative to a print head with high precision is disclosed in U.S. Pat. No. 5,549,400 titled "High Precision Dye Donor Web Positioning In A Thermal Color Printer" issued Aug. 27, 1996 in the name of Manh Tang, et al. This patent discloses a thermal resistive printer that includes a web transport for positioning a dye donor web along a path and a sensor along the path and spaced from a print line for detecting arrival of a leading edge of a dye frame and that further includes a control for the web transport. However, this patent does not disclose a device for precisely positioning a dye receiver portion for printing successive images onto the dye receiver portion with precise color registration and constant length, as the dye receiver portion unwinds from a roll of dye receiver.

Therefore, there has been a long-felt need to provide a printer and method adapted to precisely position a dye receiver portion for printing successive images onto the dye receiver portion with precise color registration and constant length, as the dye receiver portion unwinds from a roll of dye receiver.

SUMMARY OF THE INVENTION

The present invention resides in a printer comprising a print head for successively printing a plurality of images on a dye receiver unwinding from a dye receiver roll, each image having a constant predetermined length. The printer includes a rotator engaging the dye receiver roll for rotating the dye receiver roll by a plurality of incremental steps, so that the dye receiver is unwound from the dye receiver roll. The printer also includes a computer connected to the dye receiver roll for computing the incremental steps by which to rotate the dye receiver roll. The computer computes the incremental steps as a function of change of diameter of the dye receiver roll as each image of constant predetermined length is successively printed.

An object of the present invention is to provide a printer and method adapted to precisely position a dye receiver portion for printing successive images onto the dye receiver portion with precise color registration and constant length, as the dye receiver portion unwinds from a roll of dye receiver.

A feature of the present invention is the provision of a first sensor and a second sensor spaced-apart from the first sensor by a distance "S" for successively sensing a leading edge portion of the dye receiver portion as the leading edge portion advances the distance "S" to be aligned with a print head.

Another feature of the present invention is the provision of a reversible stepper motor connected to the roll of dye receiver for rotating the roll of dye receiver by incremental steps.

Yet another feature of the present invention is the provision of a computer connected to the first sensor and the second sensor and also connected to the stepper motor for counting the number of stepper motor steps required for the leading edge portion to advance the distance "S" and for computing the number of stepper motor steps to print successive images of constant length as the diameter of the receiver roll decreases.

An advantage of the present invention is that the same length is obtained for successive print images even as the diameter of the receiver roll decreases.

Another advantage of the present invention is that proper color registration for each successive printed image is obtained even as the diameter of the receiver roll decreases.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
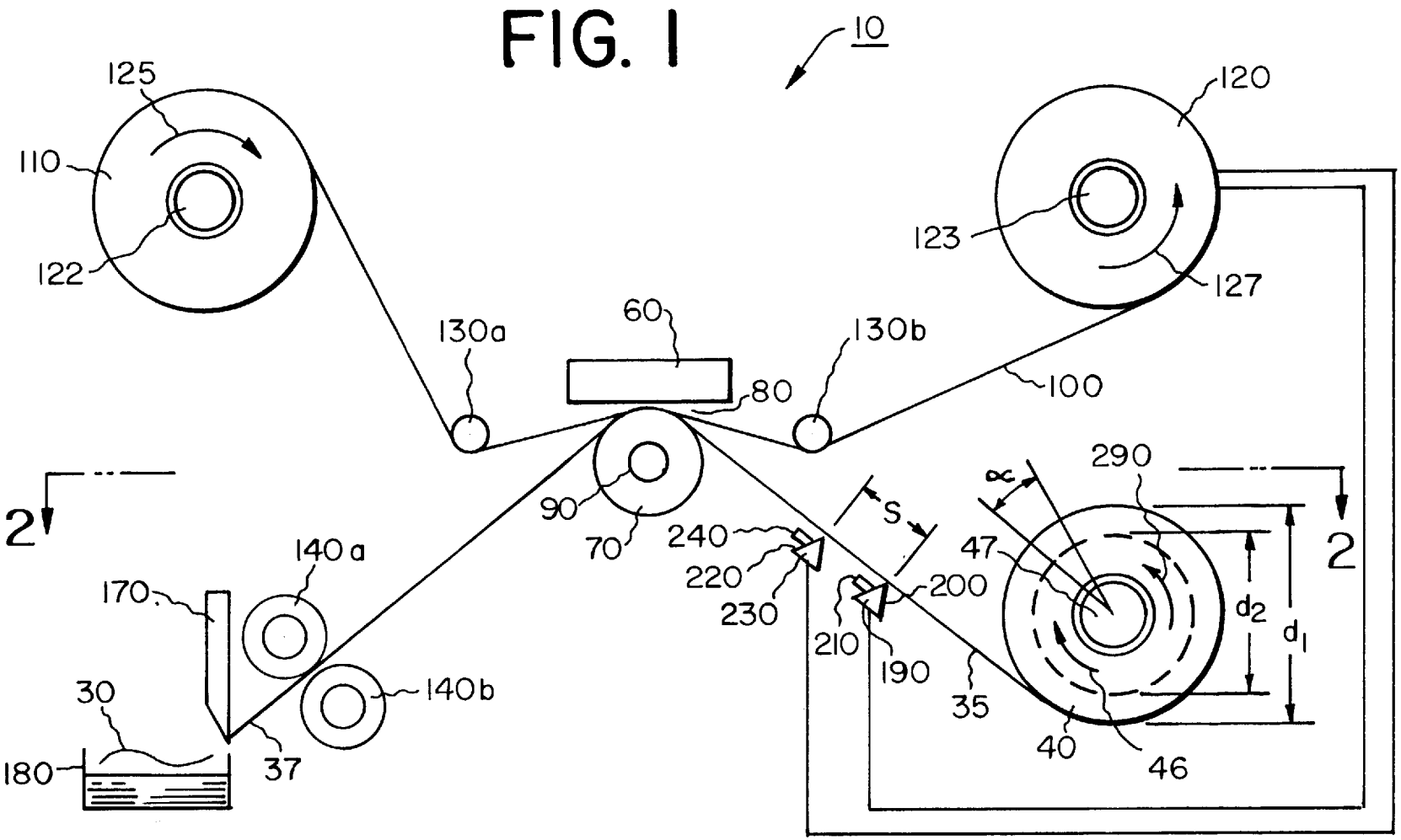
FIG. 1 is a view in elevation of a printer according to the present invention.
Figure 2:
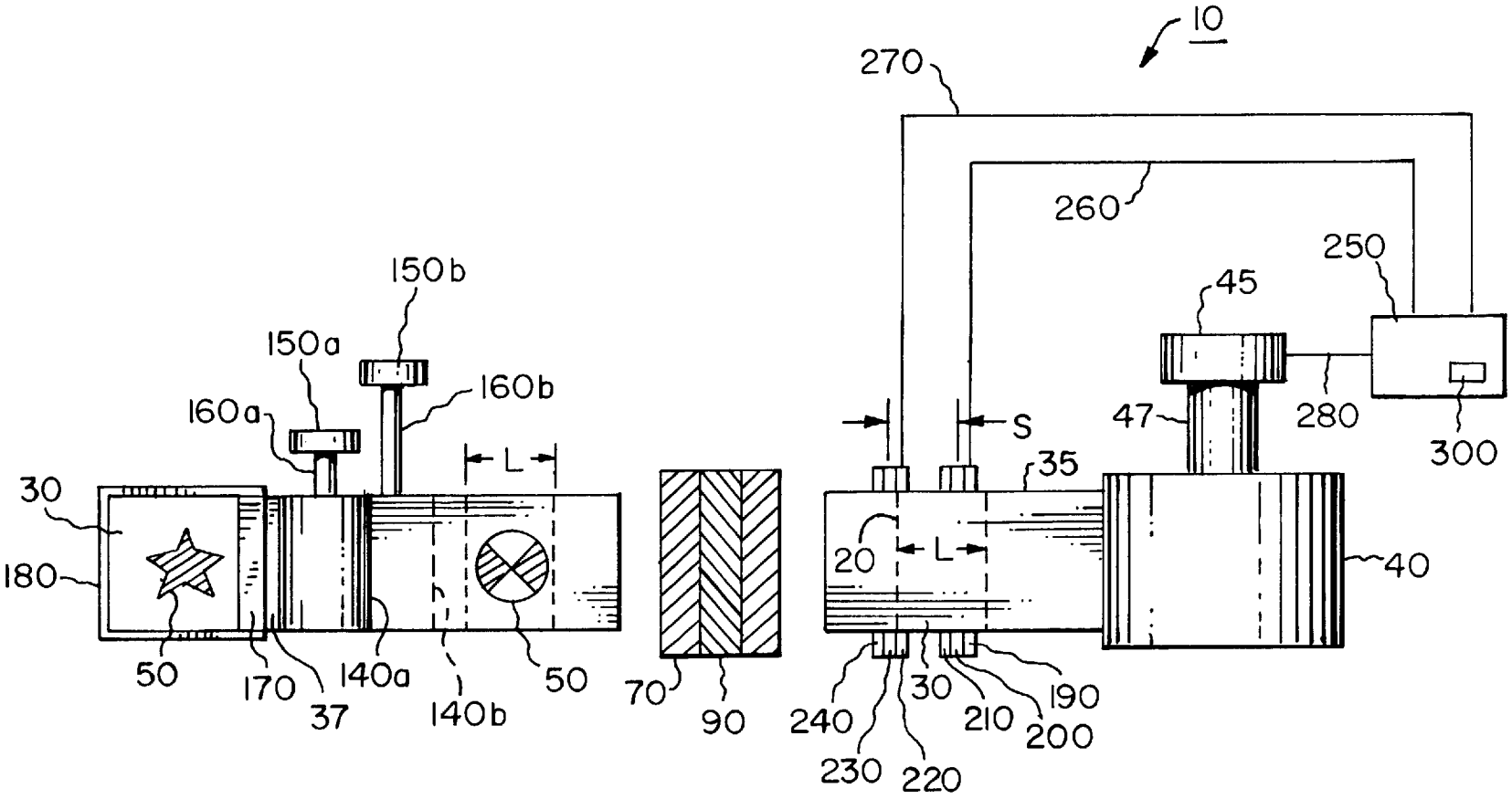
FIG. 2 is a view taken along section line 2—2 of FIG. 1.

Therefore, referring to FIGS. 1 and 2, there is shown a printer, generally referred to as 10, adapted to precisely position a leading edge 20 of a dye receiver portion 30, having a predetermined length "L" and belonging to dye receiver medium 35. In this regard, dye receiver medium 35 may be suitable paper or transparency. As disclosed in more detail hereinbelow, dye receiver medium 35, which includes an end portion 37, unwinds from a cylindrical dye receiver roll 40 having a first diameter "$d_1$" changing to a second diameter "$d_2$" as receiver 35 unwinds from receiver roll 40. Although second diameter $d_2$ is shown smaller than first diameter $d_1$, it will be appreciated that second diameter $d_2$ may be greater than first diameter $d_1$, in the instance when dye receiver medium 35 is wound upon dye receiver roll 40. Receiver 35 is unwound from about receiver roll 40 by means of a reversible rotator or stepper motor 45, which rotates receiver roll 40 preferably in a first direction illustrated by an arrow 46 and which is connected to receiver roll 40 through a shaft 47 passing longitudinally through receiver roll 40. Stepper motor 45 is capable of rotating receiver roll 40 by a plurality of incremental steps, each step producing a predetermined angle of rotation "$\alpha$". As A disclosed in detail hereinbelow, the invention precisely positions leading edge 20, so as to precisely register dye receiver portion 30 for precise successive placement of a plurality of colors onto each of a plurality of dye receiver portions 30 in order to form a plurality of full-color images 50 on dye receiver portions 30. Of course, the colors successively placed on dye receiver portion 30 in order to form each full-color image 50 may be yellow, cyan and magenta.

Referring again to FIGS. 1 and 2, printer 10 further comprises a print head, which may be a thermal resistive print head 60, for laying-down the previously mentioned colors to form each full-color image 50. Disposed adjacent print head 60 is a platen roller 70 for supporting dye receiver 35 thereon, print head 60 and platen roller 70 defining a clearance or nip 80 therebetween for reasons disclosed presently. Platen roller 70 may be a roller freely rotatable about a spindle 90. Alternatively, platen roller 70 may be driven by a motor (not shown) engaging spindle 90 for rotating platen roller 70. Thermal resistive print head 60 itself includes a plurality of thermal resistive elements (not shown) for heating a dye donor ribbon 100 in order to transfer dye therein, by means of sublimation, onto receiver portion 30 so that each image 50 is formed thereby. The thermal resistive elements are aligned along a "print line" in print head 60. Dye donor ribbon 100, which extends through nip 80, is supplied from a dye donor supply spool 110 and is taken-up by a dye donor take-up spool 120. Either or both of supply spool 110 and take-up spool 120 may be rotated about a spindle 122 and a spindle 123, in the directions illustrated by arrows 125 and 127. Such rotation of supply spool 110 and take-up spool 120 is preferably achieved by a pair of motors (not shown) suitable for this purpose, which pair of motors individually engage spindles 122 and 123 to rotate spindles 122 and 123.

Still referring to FIGS. 1 and 2, a pair of tensioning rollers 130*a* and 130*b* are disposed on opposite sides of print head 60 and engage donor ribbon 100 for removing wrinkles from (i.e., "smoothing-out") donor ribbon 100 as ribbon 100 traverses through nip 80. This is done in order to properly present a relatively flat ribbon 100 to print head 60. Such proper presentment of ribbon 100 to print head 60 allows ribbon 100 to be flush with the previously mentioned thermal resistive elements in order to eliminate image artifacts (e.g., printing streaks) that might otherwise appear in each image 50. Moreover, a pair of rotatable transport rollers 140*a* and 140*b* intimately engage opposite side surfaces of end portion 37 of receiver medium 30 for transporting dye receiver portion 30 therebetween. Transport rollers 140*a* and 140*b* may be rotated by a pair of transport motors 150*a* and 150*b*, respectively, connected to transport rollers 140*a* and 140*b* by means of axles 160*a* and 160*b*, respectively. After passing through transport rollers 140*a/b*, dye receiver portion 30, having the full color image 50, printed thereon is severed from receiver medium 35 by a blade 170. Thereafter, dye receiver portion 30 is deposited into a bin 180 for harvesting by an operator of printer 10.

However, it has been observed that, as dye receiver 35 unwinds from receiver roll 40, it is difficult to precisely register leading edge 20 of each successive dye receiver portion 30 with the print line of thermal resistive elements (not shown). That is, it is difficult to lay-down the yellow, cyan and magenta color frames onto each successive dye receiver portion 30 in exactly the same location each time in order to obtain a visually acceptable full-color images 50. That is, after each image 50 is printed, the diameter of receiver roll 40 is decreased from diameter $d_1$, to diameter $d_2$. This is so because the beginning diameter $d_1$, of receiver roll 40 to print the first image 50 decreases to a smaller diameter $d_2$ for printing the second image 50. Therefore, the amount of rotation of receiver roll 40 needs to be controlled in order to lay-down the yellow, cyan and magenta color frames onto each successive dye receiver portion 30 in exactly the same location each time. In addition, it is difficult to print images 50 having the same desired image length "L". That is, after each image 50 is printed, the diameter of receiver roll 40 is decreased from diameter $d_1$ to diameter $d_2$. This is so because the beginning diameter $d_1$ of receiver roll 40 to print the first image 50 decreases to a smaller diameter $d_2$ for printing the second image 50. Therefore, the amount of rotation of receiver roll 40 needs to be controlled to obtain the same desired length "L" for each image 50.

Therefore, referring again to FIGS. 1 and 2, printer 10 also comprises a first sensor 190 disposed sufficiently near dye receiver 35 and interposed between print head 60 and receiver roll 40 for sensing leading edge 20, as described more fully presently. In this regard, first sensor 190 may comprise a first photodiode 200, which may be an LED ( Light Emitting Deiode), for emitting a first light beam directed toward dye receiver 35. The first light beam so emitted is intercepted by dye receiver 35 and reflected thereby to a first photodetector 210 associated with first sensor 190. First photodetector 210 is positioned relative to first photodiode so as to receive the first reflected light beam and generate a first output signal in response to the first reflected light beam received by first photodetector 210. Moreover, printer 10 further comprises a second sensor 220 spaced-apart from first sensor 190 by a distance "S". Second sensor 220 is disposed sufficiently near dye receiver 35 and interposed between print head 60 and receiver roll 40 for sensing leading edge 20, as described more fully presently. In this regard, second sensor 220 may comprise a second photodiode 230, which may be an LED (Light Emitting Diode), for emitting a second light beam directed toward dye receiver 35. The second light beam so emitted is intercepted by dye receiver 35 and reflected thereby to a second photodetector 240 associated with second sensor 220. Second photodetector 240 is positioned relative to first photodiode 230 so as to receive the second reflected light beam and generate a second output signal in response to the second reflected light beam received by second photodetector 240. In this manner, leading edge 20 is capable of being sensed by sensors 190/220 in the manner disclosed immediately hereinbelow. The number of motor steps for leading edge 20 to move from first sensor 190 to second sensor 220 is counted. This count is used to determine when leading edge 20 has arrived at the beginning of the print. The first output signal generated by first sensor 190 is transmitted to a computer 250 by means of a first electrical connection 260 and the second output signal generated by second sensor 220 is also transmitted to computer 250 by means of a second electrical connection 270. Computer 250 is in turn connected to stepper motor 45 by means of a third electrical connection 280, for reasons disclosed in detail hereinbelow.

Referring yet again to FIGS. 1 and 2, stepper motor 45 rotates receiver roll 40 by a plurality of incremental steps, so that leading edge 20 is brought into alignment with first sensor 190. At this point, leading edge 20 intercepts the first light beam emitted by first photodiode 200, which first light beam is then reflected from leading edge 20 to first photodetector 210. Next, first photodetector 210 generates the first output signal, which is transmitted to computer 250 along first electrical connection 260. In this manner, the first output signal informs computer 250 to begin counting incremental steps as receiver roll 40 is rotated by stepper motor 45 during the time leading edge 20 is advanced through distance "S". Consequently, when leading edge 20 traverses distance "S" it will have arrived at second sensor 220. Computer 250 is selected so that it is capable of detecting the number of incremental steps used by stepper motor 45 to advance leading edge 20 the needed distance (i.e., "L") to bring leading edge 20 into alignment with the print line. That is, when leading edge 20 arrives at second sensor 220, leading edge 20 simultaneously aligns with the print line. At this point, leading edge 20 intercepts the second light beam emitted by second photodiode 220, which second light beam is then reflected from leading edge 20 to second photodetector 230. Next, second photodetector 220 generates the second output signal, which is transmitted to computer 250 along second electrical connection 260. The second output signal informs computer 250 to stop counting the incremental steps used by stepper motor 45 to advance leading edge 20 into alignment with the print line. The number of incremental steps used by stepper motor 45 to advance leading edge 20 into alignment with the print line is stored in memory in computer 250, such as being stored in a memory unit 300 associated with computer 250. Next, the print line of thermal resistive elements belonging to print head 60 are selectively operated to lay-down the first color frame (e.g., the yellow color frame) belonging to dye donor medium 100. Donor medium 100 is thereafter advanced by rotating supply spool 110 and take-up spool 120, so that the next color frame (e.g., cyan) is brought into alignment with the print line of resistive thermal elements. In this regard, supply spool 110 and take-up spool 120 are rotated by the previously mentioned pair of motors (not shown) engaging spindles 122 and 123. Preferably simultaneously, stepper motor 45 is then reversibly operated the precise number of steps used by stepper motor 45 to advance leading edge 20 the needed distance . That is, receiver roll 40 rotates in the direction illustrated by arrow 290, so that leading edge 20 retreats the precise distance. Dye receiver portion 30 is now ready to receive lay-down the second color (e.g., cyan). In this regard, computer 250 retrieves the incremental steps corresponding to the needed distance from memory unit 300 and communicates this stored value of incremental steps to stepper motor 45. Thereafter, stepper motor 45 is again operated the same number of incremental steps corresponding to the distance that previously brought leading edge 20 into alignment with the print line. In other words, stepper motor 45 is operated so as to rotate receiver roll 40 the required amount that brings leading edge 20 into alignment with the print line. At this point, print head 60 is operated to lay-down the second color onto dye receiver portion 30. It is understood from the disclosure herein that the color magenta is next laid-down onto dye receiver portion 30 in the same manner as the lay-down of the color cyan. In this manner, all the colors yellow, cyan and magenta are laid-down onto dye receiver portion 30, so as the form full-color image 50.

Thus, it may be understood from the teachings herein that the number of incremental steps required of stepper motor 45 in order to achieve proper color registration is a function of the distance "S" between sensors 190/220, the diameter of receiver roll 40, the constant angle "α" defined by each incremental motor step, and the desired constant image length "L" of each image 50. However, the diameter of receiver roll 40 changes from first diameter $d_1$ to second diameter $d_2$ as each image 50 is printed and severed by blade 170 from receiver 35. Thus, successive images 50 will not obtain proper color registration and the desired constant image length "L" as the diameter or receiver roll 40 changes, unless the number of incremental steps is altered between printings of successive images 50. That is, the number of incremental steps required of stepper motor 45 in order to achieve proper color registration and constant print length "L" is a function of the distance "S" between sensors 190/220, the diameter of receiver roll 40, the constant angle "α" defined by each incremental motor step, in addition to the desired constant image length "L" of each image 50, as follows:

$$NIS=f(S, D, \alpha, L) \qquad \text{Equation (1)}$$

or $$NIS=\{S/[\pi\times D/(360/\alpha)]\}\{L/S\} \qquad \text{Equation (2)}$$

where,

NIS≡number of required incremental motor steps;

S≡distance between first and second sensors 190/220 (e.g., inches);

D≡diameter of receiver roll 40 at start of printing (e.g., inches);

α≡angle corresponding to one incremental motor step (degrees); and

L≡desired constant print length (e.g., inches).

However, it is observed from Equations (1) and (2) that the operator of printer 10 need only specify the desired print length "L" to be consistently achieved by printer 10 as first diameter $d_1$ changes to second diameter $d_2$ during printing of each successive image 50. Distance "S" is known. The value of angle "α" is also known because it is typically measurable or available from the manufacturer of stepper motor 45. Diameter "D" is measured by computer 250, by any suitable means, such as by a gauge (not shown) connecting computer 250 to receiver roll 40. This diameter "D" has a value either of "d1" or "d2". Thus, all the quantities of Equations (1) and (2) are known, except for the quantity "L". However, the quantity "L" is chosen by the operator of printer 10 and preferably input to computer 250. Computer 250 then computes the number of incremental motor steps required to rotate receiver roll 40 in order to obtain a constant length "L" for each successive receiver portion 30 containing image 50.

In order that the invention may be more fully understood, the following examples are provided to illustrate the manner in which the number of incremental steps are obtained to achieve proper color registration and the same image length "L" for each image 50. Therefore, by way of example only and not by way of limitation:

EXAMPLE I

NIS={S/[π×D/(360/α)]}{L/S}incremental motor steps

NIS={2/[3.14 ×2]/(360/1)]}{6/2}=345 incremental motor steps where,

S=2 inches;

D=2 inches;

α=one degree; and

L=6 inches.

Another example is illustrative of the manner in which the number of incremental steps are obtained to achieve proper color registration and the same image length "L" for each image 50. Therefore, by way of example only and not by way of limitation:

EXAMPLE II

NIS={S/[π×D/(360/α)]}{L/S}incremental motor steps

NIS={2/[3.14×2)/(360/2)]}{6/2}=171 incremental motor steps where,

S=2 inches;

α=2 degrees;

D=2 inches; and

L=6 inches.

It is appreciated from the disclosure hereinabove that an advantage of the present invention is that the same length "L" is obtained for successive print images 50 even as the diameter of receiver roll 40 decreases from first diameter $d_1$ to second diameter $d_2$. This is so because first sensor 190 and second sensor 230 in combination with computer 250 and stepper motor 45 always rotates receiver roll 40 the proper amount.

It is also appreciated from the disclosure hereinabove that another advantage of the present invention is that proper color registration for each successive printed image 50 is obtained even as the diameter of the receiver roll 40 decreases. This is so because first sensor 190 and second sensor 230 in combination with computer 250 and stepper motor 45 always rotates receiver roll 40 the proper amount during lay-down of each color frame for all images 50 regardless of the diameter of receiver roll 40.

The invention has been described in detail with particular reference to certain preferred embodiments thereof, but it will be understood that variations and modifications can be effected within the spirit and scope of the invention. For example, the invention is described as including a thermal resistive print head 60. However, print head 60 may be any suitable print head such as an inkjet print head for forming images 50 on receiver medium 35. In this case, dye donor ribbon 100 is not required. As another example, the invention is described as including first and second sensors 190/220 that include photodiodes and photodetectors. However, first and second sensors 190/220 may be any suitable sensors, such as mechanical sensors (e.g., so-called "limit sensors")

Moreover, as is evident from the foregoing description, certain other aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

Therefore, what is provided is a printer and method adapted to precisely position a dye receiver portion for printing successive images onto the dye receiver portion with precise color registration and constant length, as the dye receiver portion unwinds from a roll of dye receiver.

PARTS LIST

| | |
|---|---|
| $\alpha$ | angle of rotation |
| $d_1$ | first diameter |
| $d_2$ | second diameter |
| L | length of dye receiver portion |
| S | distance between first and second sensors |
| 10 | printer |
| 20 | leading edge |
| 30 | dye receiver portion |
| 35 | dye receiver medium |
| 37 | end portion (of dye receiver medium) |
| 40 | dye receiver roll |
| 45 | stepper motor |
| 46 | arrow |
| 47 | shaft |
| 50 | image |
| 60 | print head |
| 70 | platen roller |
| 80 | nip |
| 90 | spindle |
| 100 | dye donor ribbon |
| 110 | dye donor supply spool |
| 120 | dye donor take-up spool |
| 122 | spindle |
| 123 | spindle |
| 125 | arrow |
| 127 | arrow |
| 130a/b | tensioning rollers |
| 140a/b | transport rollers |
| 150a/b | transport motors |
| 160a/b | axles |
| 170 | blade |
| 180 | bin |
| 190 | first sensor |
| 200 | first photodiode |
| 210 | first photodetector |
| 220 | second sensor |
| 230 | second photodiode |
| 240 | second photodetector |
| 250 | computer |
| 260 | first electrical connection |
| 270 | second electrical connection |
| 280 | third electrical connection |
| 290 | arrow |
| 300 | memory unit |

What is claimed is:

1. A printer, comprising:

(a) a print head for successively printing a plurality of images on a dye receiver unwinding from a dye receiver roll, each image having a constant predetermined length;

(b) a rotator engaging the dye receiver roll for rotating the dye receiver roll by a plurality of incremental steps, so that the dye receiver is unwound from the dye receiver roll; and (c) a computer connected to said dye receiver roll for computing the incremental steps by which to rotate the dye receiver roll as a function of change of diameter of the dye receiver roll as each image of constant predetermined length is successively printed.

2. The printer of claim 1, wherein the computer comprises a counter for counting the incremental steps.

3. The printer of claim 1, wherein said print head is a thermal resistive print head.

4. A printer adapted to position a dye receiver portion unwinding from a dye receiver roll of predetermined diameter, comprising;

(a) a print head for successively printing a plurality of images on the dye receiver portion unwinding from the dye receiver roll, each image having a constant predetermined length;

(b) a first sensor disposed near the dye receiver portion unwinding from the dye receiver roll for sensing the dye receiver portion;

(c) a second sensor spaced-apart from said first sensor and disposed near the dye receiver portion unwinding from the dye receiver roll for sensing the dye receiver portion;

(d) a stepper motor engaging the dye receiver roll for rotating the dye receiver roll by a plurality of incremental steps, so that the dye receiver is unwound from the dye receiver roll and so that the dye receiver portion is displaced from said first sensor to said second sensor; and (e) a computer interconnecting said first sensor, said second sensor and said stepper motor for computing the plurality of incremental steps by which to rotate the dye receiver roll to bring the dye receiver portion from the first sensor to the second sensor, the plurality of incremental steps being a function of change of diameter of the dye receiver roll as each image of constant predetermined length is successively printed, whereby the constant predetermined length is obtained as said computer computes the incremental steps.

5. A method of positioning a dye receiver portion unwinding from a dye receiver roll of predetermined diameter in a printer, comprising the steps of:

(a) operating a print head for successively printing a plurality of images on a dye receiver unwinding from a dye receiver roll, each image having a constant predetermined length;

(b) operating a rotator engaged with the dye receiver roll for rotating the dye receiver roll by a plurality of incremental steps, so that the dye receiver is unwound from the dye receiver roll; and (c) operating a computer connected to the dye receiver roll for computing the incremental steps by which to rotate the dye receiver roll as a function of change of diameter of the dye receiver roll as each image of constant predetermined length is successively printed.

6. The method of claim 5, wherein the step of operating a computer comprises the step of counting the incremental steps.

7. The method of claim 5, wherein the step of operating print head comprises the step of operating a thermal resistive print head.

8. A method of positioning a dye receiver portion unwinding from a dye receiver roll of predetermined diameter in a printer, comprising the steps of;

(a) operating a print head for successively printing a plurality of images on the dye receiver portion unwinding from the dye receiver roll, each image having a constant predetermined length;

(b) operating a first sensor disposed near the dye receiver portion unwinding from the dye receiver roll for sensing the dye receiver portion;

(c) operating a second sensor spaced-apart from the first sensor and disposed near the dye receiver portion unwinding from the dye receiver roll for sensing the dye receiver portion;

(d) operating a stepper motor engaging the dye receiver roll for rotating the dye receiver roll by a plurality of incremental steps, so that the dye receiver is unwound from the dye receiver roll and so that the dye receiver portion is displaced from the first sensor to the second sensor; and (e) operating a computer interconnecting the first sensor, the second sensor and the stepper motor for computing the plurality of incremental steps by which to rotate the dye receiver roll to bring the dye receiver portion from the first sensor to the second sensor, the plurality of incremental steps being a function of change of diameter of the dye receiver roll as each image of constant predetermined length is successively printed, whereby the constant predetermined length is obtained as the computer computes the incremental steps.

* * * * *